US005385498A

United States Patent [19]

Parvardeh

[11] Patent Number: 5,385,498

[45] Date of Patent: Jan. 31, 1995

[54] RECREATIONAL FLOATING CAGE

[76] Inventor: Mohammad Parvardeh, 2565 ½ Washington Rd., Augusta, Ga. 30904

[21] Appl. No.: 230,528

[22] Filed: Apr. 20, 1994

[51] Int. Cl.[6] ..... B63C 9/08

[52] U.S. Cl. ..... 441/129; 472/129

[58] Field of Search ..... 114/345, 352–354; 441/66, 78, 129; 440/98–100; 472/129; 482/78; 280/206

[56] References Cited

U.S. PATENT DOCUMENTS

| | | | |
|---|---|---|---|
| 3,083,037 | 3/1963 | Gordon et al. | 482/78 |
| 3,156,486 | 11/1964 | Fenwick | 482/78 |
| 3,334,915 | 8/1967 | Sulyma et al. | 482/78 |
| 3,664,290 | 5/1972 | Finn | 441/78 |
| 3,675,259 | 7/1972 | Gilchrist | 441/78 |
| 4,579,336 | 4/1986 | Morin | 280/206 |

FOREIGN PATENT DOCUMENTS

| | | | |
|---|---|---|---|
| 2356554 | 1/1978 | France . | |
| 2624291 | 12/1977 | Germany . | |
| 634998 | 2/1962 | Italy | 472/129 |

*Primary Examiner*—Edwin L. Swinehart

*Attorney, Agent, or Firm*—Richard C. Litman

[57] ABSTRACT

An open cage for occupancy by a person, for recreational water activities. The person walks, runs, or otherwise maneuvers while inside, thus rotating the cage and propelling the same across the water. The open frame has floats attached to the exterior, the floats comprising toroidal, inflatable members, such as rubber, pneumatic inner tubes. Paddles comprising a cruciform arrangement of rigid sheets are attached to the open frame and project from inside each toroidal float. The paddles enhance engagement of the water, and the cruciform configuration enables the paddle to be effective regardless of the angle of travel across the water surface. The floats are strapped around cage frame members, there being an interior plate which anchors the straps and which clips to cage frame members. A friction tread disposed upon each plate affords a foot hold to a user. The cage frame assembles in peg and socket fashion. The entire device is manually and readily assembled and disassembled, and when disassembled, can be carried in a large suitcase or the trunk of a small automobile.

19 Claims, 4 Drawing Sheets

RECREATIONAL FLOATING CAGE

BACKGROUND OF THE INVENTION

1. Field of the Invention

The present invention relates to a floating recreational device comprising a cage generally defining the surface of a sphere, and which is occupied by a person. The device is propelled from within by rotation while on the water surface by the occupant.

2. Description of the Prior Art

Floating, occupied recreational devices for occupancy by a person are known in the prior art. Two examples of the skeleton frame type are seen in U.S. Pat. Nos. 3,675,259, issued to David W. Gilchrist on Jul. 11, 1972, and 4,579,336, issued to Dennis Morin on Apr. 1, 1986. The device of Gilchrist '259 includes straight external frame members joined together at hubs. While generally spherical in configuration, the impression is of a sphere having adjacent flat, planar facets. In one embodiment, buoyancy is provided by forming the structural frame members from hollow, air filled members, which air filled members may be inflatable.

It should be noted that the device of Gilchrist '259 has screens or similar panels partly sealing the otherwise open facets between skeleton frame members. These screens have openings which can pass water and air therethrough, but which do not permit a person to enter and exit. In this sense, the device is not open.

Morin '336 provides a cage formed by hoops, so that individual frame members follow the spherical external contour. Morin's device features a bar disposed along a diameter, which bar serves as an axle to which a seat is attached. The seat depends from the bar, so that gravity causes the seat to maintain upright orientation, except during violent maneuvering. Intended for rolling down an incline on solid ground, the Morin device has braking and steering abilities.

German Patent Document No. DT 2624291, dated Dec. 15, 1977, discloses a hollow, essentially spherical device for occupancy by a person while on a water surface. The sphere is made up from two semispherical members hinged together in clamshell fashion. An inside running surface is textured to enable a user to gain a foothold. The external surface is textured to engage the water to enable propulsion. The external boundary of the sphere is sealed, so that the interior is enclosed and watertight. In this device, and others having full or partial sealing of the interior, the walls may tend to act as sails, imparting force from the wind so as to possibly counteract the direction chosen by the user when propelling the device.

French Patent Document No. 2,356,554, dated Jan. 27, 1978, discloses an open, recreational water wheel. The overall configuration is that of a disc, there being two parallel, spaced apart rings connected in treadmill or squirrel cage fashion by rungs bridging the gap between the rings. Each rung straps at each end to one ring, a strap encircling the ring. A user is exposed to the water at openings located between adjacent rungs and at the larger opening of each ring.

A large cylindrical recreational device is seen in U.S. Pat. No. 3,664,290, issued to Arthur F. Finn on May 23, 1972. The cylinder is of variable diameter, greatest in the middle of the cylinder, in the manner of a wooden barrel, and open at both ends of the cylinder. There are fins or paddles periodically disposed about the external surface of the device for improvement of engagement of water, to assist propulsion. A person stands inside the device and walks or runs, thus turning the device in the manner of a squirrel cage.

None of the above inventions and patents, taken either singly or in combination, is seen to describe the instant invention as claimed.

SUMMARY OF THE INVENTION

The present invention provides a practical, knock down floating cage which has excellent responsiveness to change of direction when in use. The frame comprises hubs having a plurality of sockets, and linear structural members inserted into these sockets. The linear members are secured within their respective sockets by pins. When fully assembled, the skeleton frame generally defines a sphere open to the exterior.

Two important benefits accrue from open construction. The first is that rapid ingress and egress are enabled. Thus, a person can quickly escape from the device, should that become necessary. Alternatively, a person can enter quickly, as might be required in the case of emergency rescue or aid.

Another important benefit is that whereas closed devices, such as those of Gilchrist '259 and of the German reference '291, are prone to being driven by the force of wind in the manner of a sail, and thus reducing control thereof by the user within, the novel device is less susceptible to this external influence.

The generally spherical configuration imparts more versatility than those devices configured generally as cylinders or discs. Whereas the latter are substantially confined to unidirectional travel, spherical devices are propelled in any direction on the surface of the water. Also, a spherical device is not subject to being knocked over, there being no special preferred orientation with respect to the water.

Floats are attached periodically about the exterior of the frame in order to provide buoyancy which will accommodate both the frame and an occupant. In a preferred embodiment, these floats are provided by rubber inner tubes. Inner tubes are advantageous since they are strong, readily available, inflatable, and provided with a suitable inflation valve compatible with commonly available compressed air equipment.

Paddles are provided which comprise a cruciform arrangement of rigid sheets. A planar paddle would operate effectively only when the recreational device travels in a direction perpendicular to the planar paddle. However, the cruciform configuration renders the paddle effective regardless of the angle of travel with respect to the major plane of the paddle. In combination with the overall spherical configuration of the cage, a device is thus provided which enables travel in any direction along the water surface.

The entire device is manually assembled and disassembled. The floats are strapped to the frame, and the paddles clip to the frame. Furthermore, the paddles are arranged to project through the openings of the toroidal floats, so that the floats also reinforce the paddles against reactive forces arising from propulsion. This reinforcement frees uncomplicated, small resilient clips securing the paddles to the frame from the necessity of being sturdy enough to resist the said reactive forces by themselves.

The recreational device breaks down into a compact collection of components capable of being stored and transported in a relatively small receptacle. An embodiment of the novel device accommodating a six foot (2 meter) tall user can easily be carried in a large suitcase and in the trunk of a small automobile. Hence, the invention is readily transported to lakes, beaches, and other suitable areas for use.

Accordingly, it is a principal object of the invention to provide a recreational floating cage which is readily assembled and disassembled by hand.

A second object of the invention is to provide a safe vehicle for propulsion across the surface of the water.

It is another important object of the invention to provide a recreational floating cage which enables propulsion at any angle to the surface of the water.

It is again an object of the invention to enable omnidirectional visibility therefrom.

It is still another object of the invention to enable rapid ingress to and egress from the novel device.

It is a further object of the invention to provide a recreational floating cage which disassembles into a compact volume.

Still another object of the invention is to provide floats from strong, inflatable, commonly available objects.

An additional object of the invention is to provide toroidal floats and paddles projecting through the openings of the toroidal floats, the toroidal floats reinforcing the paddles against reactive forces arising from propulsion of the recreational floating cage.

Yet a further object of the invention is to avoid construction which is susceptible to being wind driven.

It is again an object of the invention to provide a skeleton or open frame formed from socket bearing hubs and linear members mutually connected in pin and socket fashion.

Yet another object of the invention is to provide a recreational floating cage which is generally spherical in overall configuration, including areas substantially open to the exterior.

Still a further object of the invention is to secure floats to the open frame by straps having manual fasteners.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
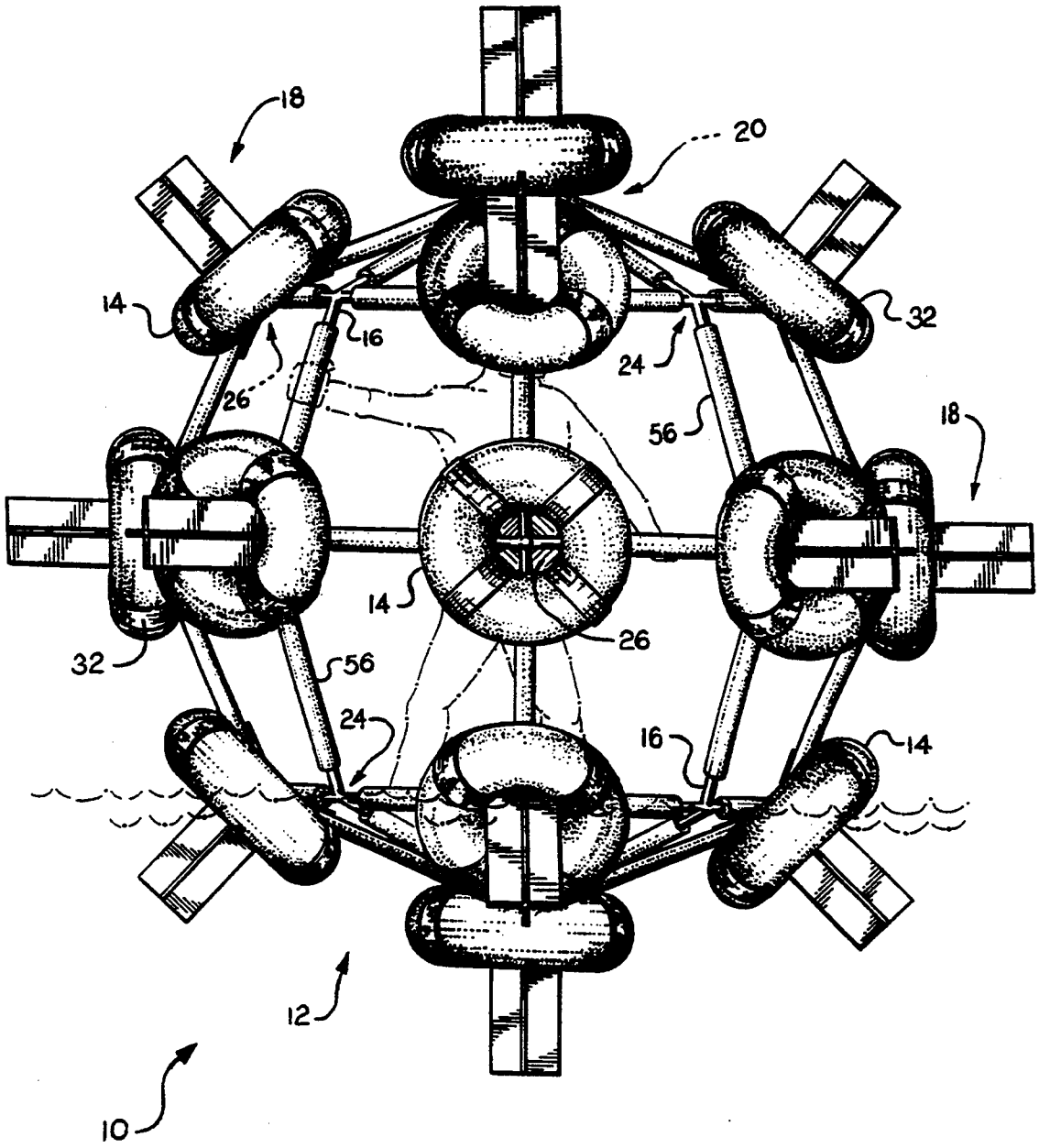
FIG. 1 is an environmental, side elevational view of the invention, with environmental elements shown in phantom lines.

Turning now to FIG. 1 of the drawings, the recreational floating cage 10 is seen in an environmental setting. Floating cage 10 is sufficiently large to accommodate a user therewithin, and is light enough to float with most of its volume above the surface of the water. Floating cage 10 has a frame 12 comprising a grid arranged substantially as the surface of a sphere having planar facets, and having an empty or open interior. Floats 14 are attached periodically about frame 12. Because linear structural frame members are provided by pipes 16, which are hollow, even a metal framed floating cage 10 has sufficient buoyancy to be supported by floats 14 of the type described hereinafter.

The user steps on and grasps members of frame 12, and maneuvers floating cage 10 so as to rotate the same. This rotation causes paddles 18 provided periodically about frame 12 to engage the water, and propel floating cage 10 across the water surface. A certain degree of dexterity and balance are required to accomplish maneuvering. After sufficient practice to master maneuvering, the ability to float nearly effortlessly on a water surface, and to negotiate a desired course will afford both the user and onlookers considerable amusement.

Figure 4:
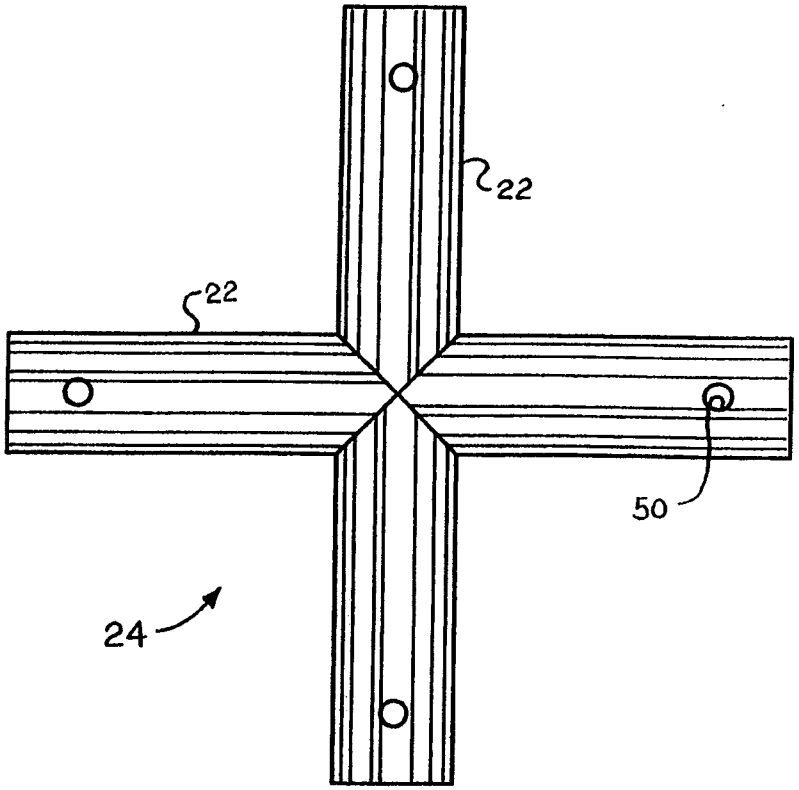
FIGS. 3 and 4 are top plan views of the two types of hub connectors of the frame, drawn to enlarged scale.
Figure 3:
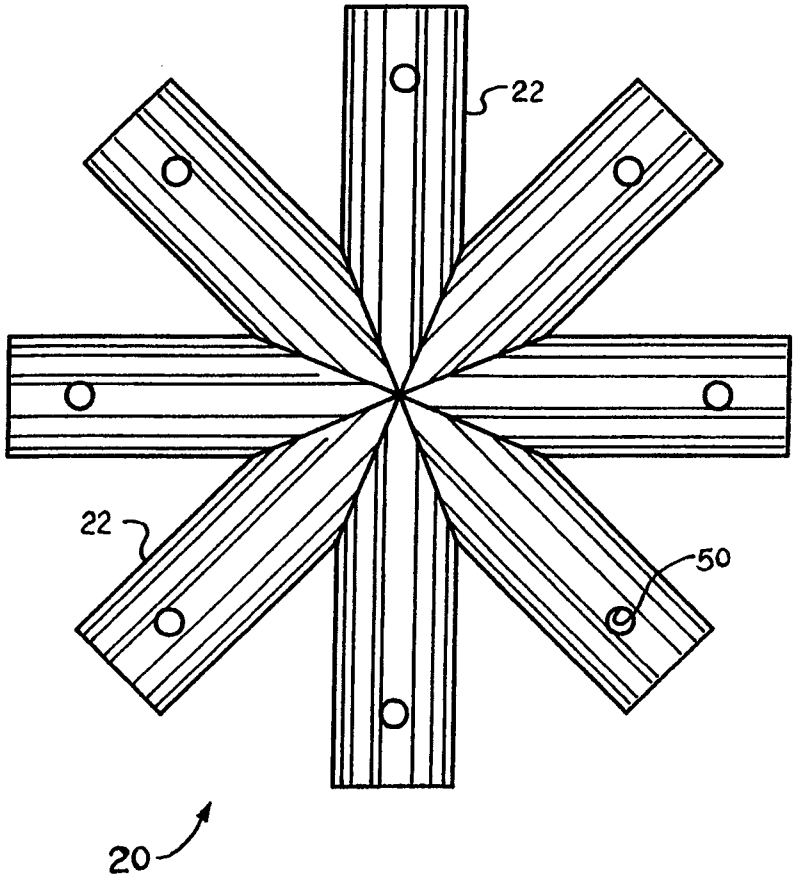

Frame 12 comprises linear sections of pipe 16 joined at points of intersection. At each intersection, there is a hub connector. At opposed ends of the sphere, at locations corresponding to north and south poles, when compared to the Earth, eight pipes 16 converge at first hub connectors 20, which have eight sockets 22 (see FIG. 3). At all other intersections, four pipes converge at second hub connectors 24, which have four sockets 22 (see FIG. 4). It must be noted that FIGS. 3 and 4 are plan views, and hub connectors 20, 24 are three dimensional. The actual configuration is better observed by examination of FIG. 1. The actual angles between sockets 22 for any hub connector 20 or 24 are dictated by the number and spacing of linear members 16, which obviously may be varied as desired.

Floats 14 are attached to frame 12 at hub connectors 20, 24. Paddles 18 are also located at hub connectors 20, 24 and protrude through floats 14 for reinforcement. Paddles 18 are dimensioned and configured to fit tightly within the central opening of toroidal floats 14, so that they are braced against a moment imposed thereon by the water when floating cage 10 is rotated.

Figure 2:
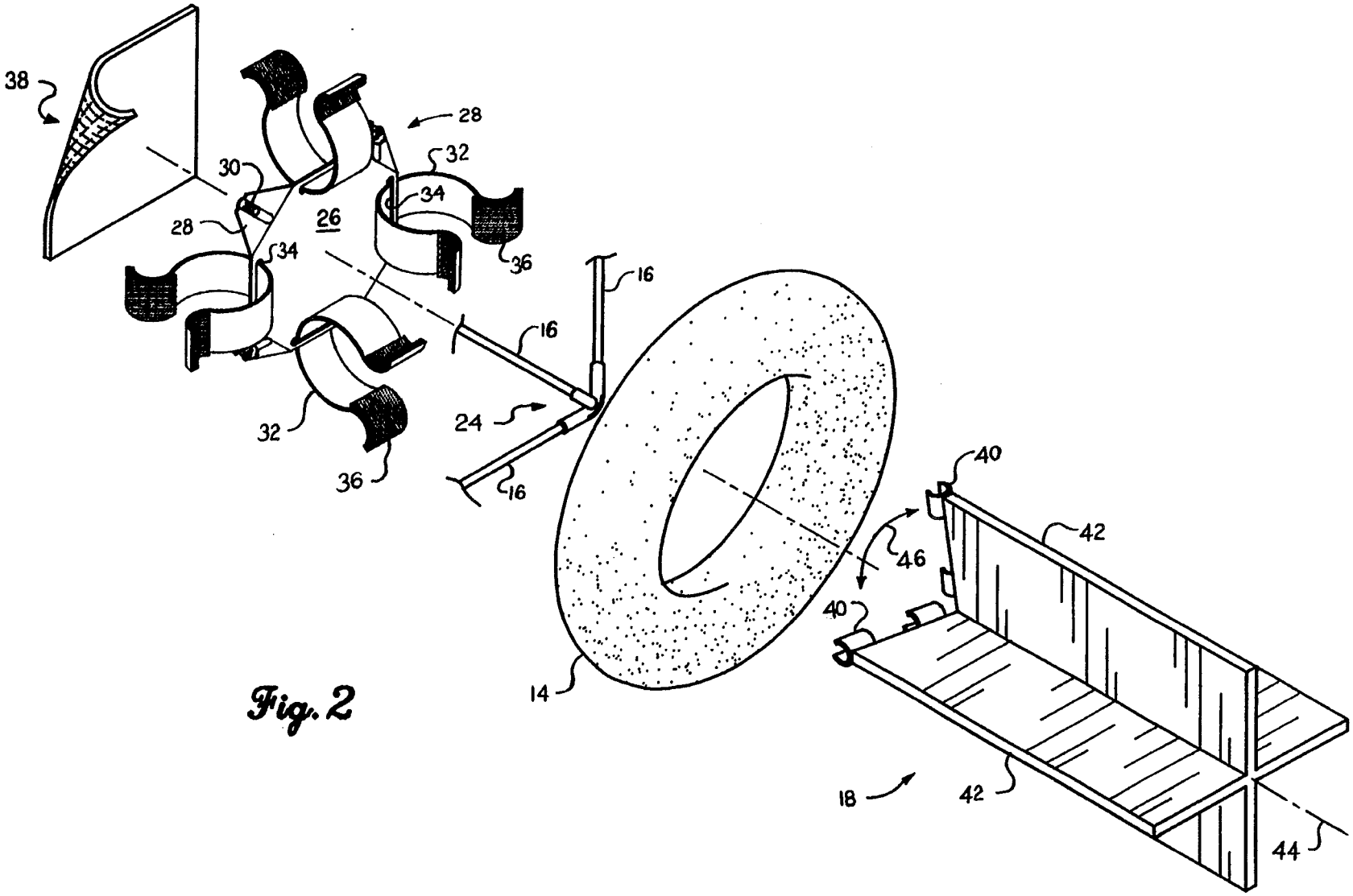
FIG. 2 is an exploded, perspective detail view of components of a typical float and hub assembly, drawn to enlarged scale.

Referring now to FIG. 2, attachment of floats 14 and paddles 18 is enabled by reinforcement plates 26. Each reinforcement plate 26 comprises a sheet of metal or the like having bent corners 28, to cooperate with pipes 16, avoiding interference therewith. Clips 30 hold a reinforcement plate 26 to pipes 16. Clips 30 are shown in greater detail in FIG. 7, and are seen to include retaining pins 31. Returning to FIG. 2, flexible straps 32 pass through slots 34 formed in a reinforcement plate 26, and are dimensioned and configured to encircle a portion of a float 14 and a portion of a reinforcement plate 26. Straps 32 are provided with corresponding patches of hook and loop material 36, so that floats 14 are readily assembled to and removed from frame 12. The interior face of a reinforcement plate 26 is provided with a member having foot tread 38, to provide additional places to gain a foothold.

Floats 14 may be of any construction providing requisite strength and low density. In a preferred embodiment, floats 14 are provided by rubber inner tubes for pneumatic motor vehicle tires. This is because such tubes are readily available, inexpensive, already provided with valves suitable for inflation and deflation, and are inflatable. Inflatable, flexible tubes enable a stored float 14 to assume compact dimensions for storage. Of course, floats 14 could be made from rigid or resilient expanded synthetic resins, or other low density materials.

Figure 7:
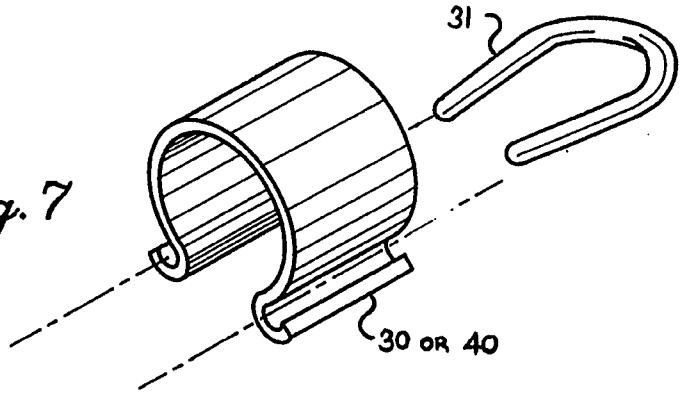
FIG. 7 is a perspective detail view of a clip and retaining pin employed in the novel structure, drawn to enlarged scale.

Paddles 18, in addition to fitting closely within respective floats 14, are attached to frame members 16 by clips 40. Clips 40 are also seen in the detail of FIG. 7, and also include retaining pins 31. Attachment by clips 40 as well as by friction fit within floats 14 is desirable since floats 14 resist moments imposed on paddles 18, but cannot resist a force thereon which acts through the opening of the torus.

Paddles 18 are constructed with, preferably, at least three panels 42 arranged to intersect at a common axis 44. Any two panels 42, or reaction surfaces thereof, define an acute or obtuse angle 46 therebetween. Acute or obtuse angle 46 will be referred to hereinafter as "angle" for brevity. In the present example, four panels 42 are illustrated. This arrangement assures that two surfaces defining an angle therebetween always face oppositely to the direction of travel of floating cage 10 at all directions of such travel. A single, substantially planar paddle could knife ineffectually through the water, when urged at an appropriate angle to the water. When at least two planar paddle panels arranged at an angle to one another are provided, this situation is avoided, and propulsion in response to rotation of floating cage 10 is assured.

The spherical configuration of frame 12 combines with this arrangement of paddles 18 to assure that floating cage 10 thus not be limited to linear travel, but may be propelled under power in all directions on the surface of the water.

Figure 5:
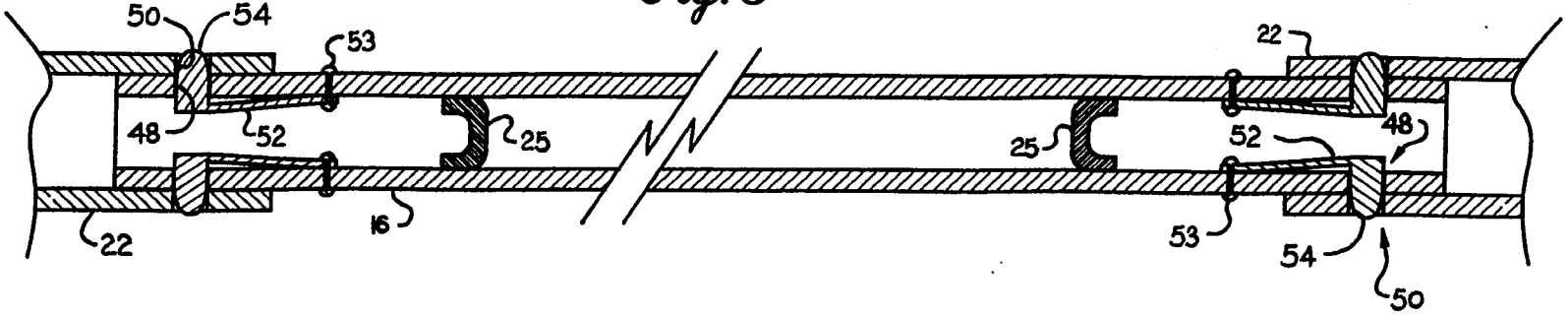
FIG. 5 is a partly cross sectional, partly fragmentary detail view of linear frame members which connect to hub connectors, drawn to enlarged scale.

Frame construction will now be further described, with reference to FIG. 5. As will be recalled from FIG. 2, pipes 16 penetrate sockets 22 formed in hub connectors 20 and 24, in telescoping fashion. Pipes 16 preferably include plugs 25, of any suitable type and material, for excluding water from the interior, thus increasing buoyancy of pipes 16.

To avoid disengagement of pipes 16 from their sockets 22, pipes 16 are locked to sockets 22 by pins 52. Both pipes 16 and sockets 22 are provided with alignable holes 48 and 50, respectively. Pins 52 are permanently mounted inside each pipe 16, as by rivets 53. Each pin 52 has a rounded head 54 which protrudes through aligned holes 48 and 50, thereby locking pipes 16 into engagement with an associated socket 22. Any number of pins 52 may be provided for each socket 16.

Figure 6:
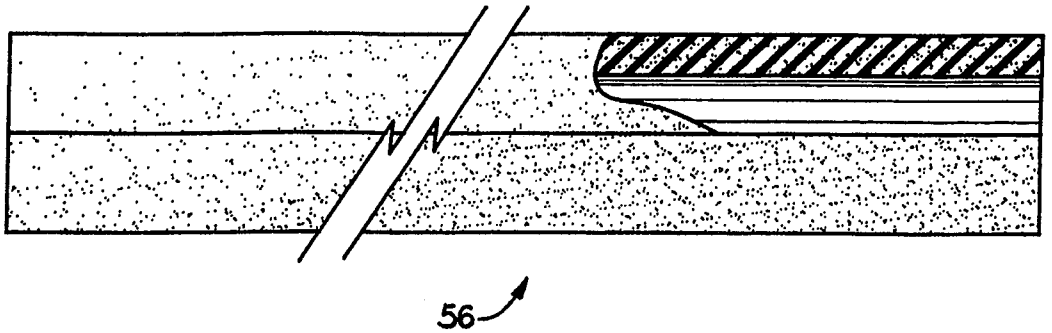
FIG. 6 is a side elevational, partly fragmentary, partly cross sectional detail view of padding placed around linear frame members, drawn to enlarged scale.

Individual pipes 16 have padded liners 56 disposed thereabout, to cushion a person should a fall result in impact with rigid pipes 16. Also, grip of a pipe 16 by hand or foot is rendered more secure when a padded liner 56 resiliently conforms to the hand or foot. As seen in FIG. 6, padded liners 56 are preferably made from a resilient, expanded synthetic resin material, which resists water logging. Such material is readily available, preformed to cooperate with pipes, as plumbing insulation. Padded liners 56 are formed as sleeves, which are slipped over pipes 16. Sleeves may be longitudinally preslit, in which case they will have to be taped or otherwise secured to pipes 16.

The novel floating cage 10 is thus readily and manually assembled and disassembled, and compactly stored and transported. It is practical and safe, being provided with padded interior surfaces and improved handholds and footholds. Manufacturing is rendered practical by reliance upon commonly available parts and materials.

It is to be understood that the present invention is not limited to the embodiments described above, but encompasses any and all embodiments within the scope of the following claims.

I claim:

1. A recreational floating cage comprising:

an open frame including rigid, tubular members and hub connector members, said open frame generally defining a surface of a sphere having an empty interior;

float members having means for attaching said float members to said open frame; and paddles having means for attaching said paddles to said open frame.

2. The recreational floating cage according to claim 1, said rigid tubular members having means defining first holes therein and said hub connector members having means defining second holes therein, said first and second holes being alignable, said linear structural members and said hub connector members mutually connecting by telescoping fit, there further being pins individually insertable through associated said first and second holes.

3. The recreational floating cage according to claim 1, said paddles each having at least two surfaces defining an angle therebetween.

4. The recreational floating cage according to claim 1, each paddle having at least three surfaces arranged about a common axis, wherein two of said at least three surfaces always define an angle facing oppositely to the direction of travel of said recreational floating cage at all directions of travel over the surface of the water.

5. The recreational floating cage according to claim 1, said paddles including clips for attachment to said frame.

6. The recreational floating cage according to claim 1, said rigid, tubular members having padded liners.

7. The recreational floating cage according to claim 1, said float members comprising toroidal, inflatable members.

8. The recreational floating cage according to claim 7, each of said paddles being located within the opening of one of said toroidal inflatable float members.

9. The recreational floating cage according to claim 7, said means attaching said float members to said open frame comprising straps each encircling at least one and one of said toroidal, inflatable members.

10. The recreational floating cage according to claim 9, each one of said toroidal inflatable float member further including:

a reinforcement plate cooperating with and having clips engaging said open frame and also having anchors for said straps.

11. The recreational floating cage according to claim 10, each said paddle being encircled by one of said toroidal, inflatable float members.

12. The recreational floating cage according to claim 10, each said reinforcement plate having an interior surface facing the interior of said open frame, there being at least one foot tread member disposed on at least one said reinforcement plate's interior surface.

13. A recreational floating cage comprising:

an open frame including rigid, tubular members and hub connector members, said rigid, tubular members having means defining first holes therein and said hub connector members having means defining second holes therein, said first and second holes being alignable, said rigid, tubular members and said hub connector members mutually connecting by telescoping fit, there further being pins individually insertable through associated said first and second holes, said open frame generally defining a surface of a sphere having an empty interior;

toroidal, inflatable float members and means for manually and removably attaching said float members to said open frame; and paddles having means for manually and removably attaching said paddles to said open frame, each paddle having at least three surfaces arranged about a common axis, wherein two of said at least three surfaces always define an angle facing oppositely to the direction of travel of said recreational floating cage at all directions of travel over the surface of the water, said paddles arranged so that one said paddle is partially surrounded by, and projects outwardly from, one said toroidal, inflatable float.

14. The recreational floating cage according to claim 13, said paddles including clips for attachment to said frame.

15. The recreational floating cage according to claim 13, each said rigid, tubular member having a padded liner.

16. The recreational floating cage according to claim 13, said means for manually and removably attaching said float members to said open frame comprising straps each encircling both at least one individual rigid, tubular member and one said float member.

17. The recreational floating cage according to claim 16, each one said toroidal float member further including:

a reinforcement plate cooperating with said open frame and having anchors for said straps.

18. The recreational floating cage according to claim 17, each said reinforcement plate having an interior surface facing the interior of said open frame, there being at least one foot tread member disposed on at least one said reinforcement plate interior surface.

19. A recreational floating cage comprising:

an open frame including rigid, tubular members each having a padded liner and hub connector members, said rigid, tubular member having means defining first holes therein and said hub connector members having means defining second holes therein, said first and second holes being alignable, said rigid, tubular members and said hub connector members mutually connecting by telescoping fit, there further being pins individually insertable through associated said first and second holes, said open frame generally defining a surface of a sphere having an empty interior;

toroidal, inflatable floats and straps each encircling both at least one individual rigid, tubular member and one said float, each said toroidal, inflatable float having a reinforcement plate cooperating with said open frame and having anchors for said straps, each said reinforcement plate having an interior surface facing the interior of said open frame, there being at least one foot tread member disposed on at least one said reinforcement plate's interior surface; and paddles having clips for attachment to said open frame, each paddle having at least three surfaces arranged about a common axis, wherein two of said at least three surfaces always define an angle facing oppositely to the direction of travel of said recreational floating cage at all directions of travel over the surface of the water, said paddles arranged so that one said paddle is partially surrounded by, and projects outwardly from, one said toroidal, inflatable float.

* * * * *